US005653828A

United States Patent [19]

Zhao et al.

[11] Patent Number: 5,653,828

[45] Date of Patent: Aug. 5, 1997

[54] METHOD TO PROCUCE FINE-GRAINED LAMELLAR MICROSTRUCTURES IN GAMMA TITANIUM ALUMINIDES

[75] Inventors: Linruo Zhao, Gloucester; Peter Au, Orleans; Jonathan C. Beddoes, Ottawa; William Wallace, Gloucester, all of Canada

[73] Assignee: National Research Council of Canada, Ottawa, Canada

[21] Appl. No.: 548,917

[22] Filed: Oct. 26, 1995

[51] Int. Cl.[6] ..... C22F 1/18

[52] U.S. Cl. ..... 148/671; 148/669; 419/29

[58] Field of Search ..... 148/669, 670, 148/671; 419/29

[56] References Cited

U.S. PATENT DOCUMENTS

| | | | |
|---|---|---|---|
| 5,226,985 | 7/1993 | Kim et al. | 148/671 |
| 5,296,055 | 3/1994 | Matsuda | 148/421 |
| 5,417,781 | 5/1995 | McQuay et al. | 148/671 |

FOREIGN PATENT DOCUMENTS

| | | | |
|---|---|---|---|
| 1578225 | 7/1990 | U.S.S.R. | 148/669 |

*Primary Examiner*—John Sheehan
*Attorney, Agent, or Firm*—Juliusz Szereszewski

[57] ABSTRACT

A method for producing fine-grained lamellar microstructures in powder metallurgy (P/M) and wrought gamma titanium aluminides comprises the steps of: (a) a cyclic heat treatment at a maximum temperature in the range of about 10° C. above to about 10° C. below the alpha-transus temperature ($T_\alpha$) of the alloy, and (b) a secondary heat treatment of thus cyclically heat treated alloy at a temperature between 750° C. and 1050° C. for 4 to 100 hours. For cast gamma alloys, the method comprises additionally the step of a solution treatment at a temperature in the range of about 30° C. to 70° C. above $T_\alpha$ followed by a water or an oil quench before the two steps described above. The alloys with the resulting fine-grained lamellar microstructure have an advantageous combination of mechanical properties—tensile strength, ductility, fracture toughness, and creep resistance.

8 Claims, 5 Drawing Sheets

METHOD TO PROCUCE FINE-GRAINED LAMELLAR MICROSTRUCTURES IN GAMMA TITANIUM ALUMINIDES

FIELD OF THE INVENTION

This invention relates to titanium aluminides, and more particularly, to a method for producing gamma titanium aluminide alloys and articles thereof having fine-grained lamellar microstructures, especially powder metallurgy (PM), wrought and cast gamma titanium aluminide alloys.

BACKGROUND OF THE INVENTION

Because of the favourable combination of low density, attractive elevated-temperature properties and acceptable fabricability, gamma titanium aluminides are emerging as revolutionary engineering materials to replace heavier nickel-base superalloys, steels and conventional titanium alloys for gas turbine and automotive applications with service temperatures of about 600° C. to 800° C. In recent years, tremendous research and development efforts have been made in alloy modification and microstructural control to improve mechanical properties as well as fabricability of the materials.

Gamma titanium aluminides based on TiAl phase usually contain about 45 to 49 atomic percent Al and are frequently referred to as near-gamma titanium aluminides. The constituents of the alloys normally consist of a predominant amount of TiAl (gamma) phase and a relatively minor amount of $Ti_3Al$ (alpha-2) phase. FIG. 1 is the central portion of a titanium-aluminum phase diagram. In some multi-component alloys, a small volume fraction of titanium beta phase may also exist due to the presence of beta-stabilizing elements such as Cr, W, Mo, etc. Gamma alloys are typically produced by casting, thermomechanical processing or P/M processing, and heat treatments are usually employed to control the final microstructure of the product. The conventional heat treatments applied to gamma alloys typically involve a treatment at a temperature above $T_\alpha$ (line a–b in FIG. 1) or between $T_\alpha$ and the eutectoid temperature (line c–d in FIG. 1, ≈1125° C.) for about 0.5 to 5 hours, followed by a secondary treatment at a temperature between 750° C. and 1050° C. for 4 to 100 hours to stabilize the heat treated microstructure. The cooling method used in the heat treatments can be furnace cooling, air cooling, or controlled cooling at a pre-determined rate, depending on the microstructural requirements. The typical microstructures produced by the conventional heat treatments include near gamma (NG), duplex (DP), nearly lamellar (NL), and fully lamellar (FL) structures.

Conventional processes of the type described above are exemplified in U.S. Pat. No. 5,226,985 to Kim et al. and U.S. Pat. No. 5,296,055 to Kenji.

For a given alloy composition, previous studies have shown that relatively good room-temperature tensile strength and ductility can be obtained in a duplex microstructure consisting of small equiaxed gamma grains and lamellar grains containing alternate gamma and alpha-2 lamellae. However, the room-temperature fracture toughness and elevated-temperature creep resistance of the duplex microstructure are poor. On the other hand, a fully lamellar microstructure composed of coarse lamellar grains offers much better fracture toughness and creep resistance, but unfortunately, with a substantial reduction in tensile strength and ductility. In comparison, a nearly lamellar microstructure containing predominantly large lamellar grains and a small amount of equiaxed fine gamma grains provides improved fracture toughness and creep resistance, with minimal loss in tensile property. However, the degree of improvement achieved in balancing these properties is largely dependent on the volume fraction of the equiaxed gamma grains, which appears to be difficult to control using conventional heat treatments.

Recent investigations have shown that the balance of mechanical properties for gamma alloys can be enhanced by reducing the grain size in a fully lamellar microstructure. This is because the refined grain size increases tensile strength and ductility, whereas the retained lamellar structure as well as the interlocking grain boundary morphology, associated with the lamellar structure, are beneficial for fracture toughness and creep resistance.

However, it has proven difficult to reduce the lamellar grain size solely by conventional heat treatment, and therefore several other methods have been recently developed. These methods include: (a) alloy modification, (b) thermomechanical processing (TMP) or thermomechanical treatment (TMT), or (c) XD™ (a trademark of Martin Marietta) processing. Each of these methods has advantages and limitations. Wrought gamma alloys that are compositionally modified with boron additions or large amounts of beta stabilizing elements can be heat treated in either an extended alpha plus beta two-phase region or in the alpha single-phase region with the presence of boride particles used to yield a fine-grained lamellar microstructure. However, this process is not applicable to many existing alloys which do not contain boron or large amounts of beta stabilizing elements. TMP and TMT are effective in refining the lamellar grain size in wrought alloys, however, the processes cannot be employed to refine the coarse microstructure of investment castings. Finally, XD™ processing yields a fine-grained cast lamellar microstructure through in-situ formation of $TiB_2$ particles which act as nuclei for grain formation during solidification. The larger the number of such nuclei, the smaller the resulting grain size that will be produced in the fully solidified product. However, this process is limited to alloys that contain in-situ $TiB_2$ particles and is not applicable to non-XD™ cast alloys.

Given the limitations of the above methods, it is an object of the present invention to provide a method for producing fine-grained lamellar microstructures in certain forms of gamma or near-gamma titanium aluminides, including powder metallurgy, wrought and cast alloys.

SUMMARY OF THE INVENTION

In accordance with the invention, the method for producing fine-grained lamellar microstructures in gamma titanium aluminides comprises the steps of: (a) cyclically heat treating a gamma titanium aluminide alloy at a maximum temperature in the range of about 10° C. above to about 10° C. below $T_\alpha$ of the alloy, and (b) heat treating thus cyclically heat treated alloy at a temperature between 750° C. and 1050° C. for 4 to 100 hours.

Further, in accordance with the invention, the method for refining the lamellar grain size in cast gamma alloys comprises the steps of: (a) solution heat treating the material at a temperature in the range of about 30° C. to 70° C. above $T_\alpha$ for about 20 minutes to 2 hours followed by cooling, e.g. a water or an oil quench, (b) cyclically heat treating thus solution treated material at a maximum temperature about 10° C. above to about 10° C. below $T_\alpha$, and (c) heat treating thus cyclically heat treated material at a temperature between 750° C. and 1050° C. for 4 to 100 hours.

The method of the invention applies generally to gamma titanium aluminides. For powder metallurgy (P/M) and wrought (thermomechanically processed) titanium aluminides, two basic steps i.e. a primary treatment and a secondary treatment, are effected. For the cast alloys, an additional step, preceding the two above steps, is carried out. For clarity, the additional step will also be termed hereinafter a "pretreatment", while the "primary treatment" and "secondary treatment" definitions still apply.

The definition "gamma" as used throughout this specification denotes also near-gamma titanium aluminide alloys.

The definition "fine-grained" as used throughout this specification denotes a microstructure with a grain size smaller than about 200 microns.

DETAILED DESCRIPTION OF THE INVENTION

Figure 1:
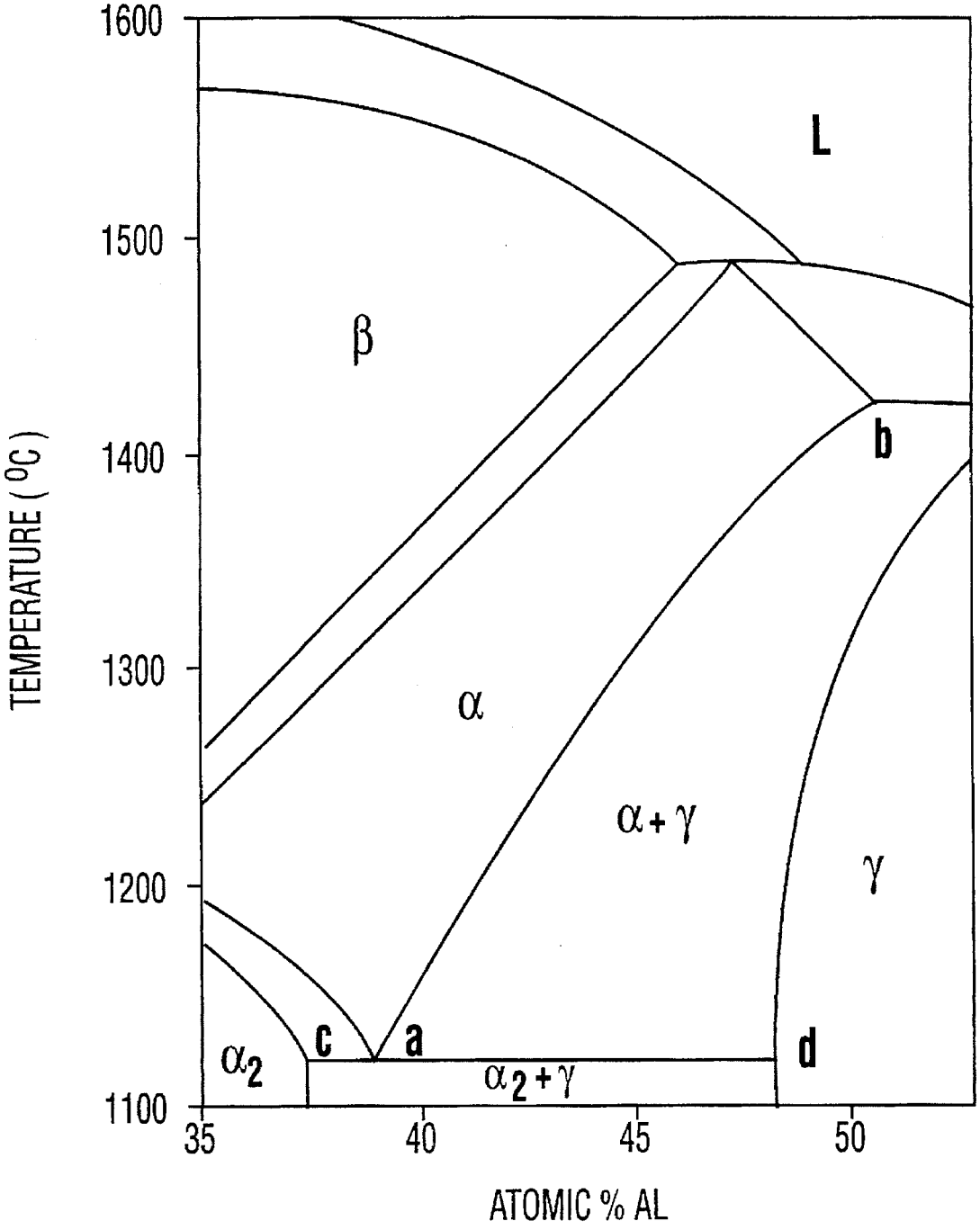
FIG. 1 is a central portion of a titanium-aluminum phase diagram.

Gamma titanium aluminides that are suitable for the purpose of the present invention can be any one of the following forms: (a) consolidated powder material, (b) thermomechanically processed (wrought) material, and (c) ingot cast or investment cast material.

For P/M and wrought alloys, the method of the invention is applicable to the entire composition range of alpha-2 plus gamma two-phase alloy which can be formulated as (a) binaries: Ti-(45–49)Al (at %) and (b) multi-component alloys: Ti-(45–49)Al-(0–3)X-(0–6)Y-(0–2)Z (at %), where X is Cr, V, Mn or any combination thereof, Y is Nb, Ta, W, Mo or any combination thereof, and Z is Si, C, B, P, Ni, Fe, Se, Te, Ce, Er, Y, Ru, Sc, Sn, or any combination thereof. For cast alloys, the method of the invention is applicable to two-phase binary alloys and to multi-component alloys in which a massive transformation can be induced during cooling from the solution heat treatment. Examples of suitable alloys include P/M Ti-48Al (at %), P/M Ti-47.5Al-3Cr (at %), P/M Ti-48Al-2Nb-2Cr (at %), wrought Ti-48Al-2Nb-2Cr (at %) and cast Ti-48Al (at %).

The starting microstructure of the powder material consolidated by hot isostatic pressing (HIP) consists predominantly of equiaxed gamma grains less than about 30 μm in size and a small amount of alpha-2 phase less than about 10 μm in size. In P/M Ti-47.5Al-3Cr and Ti-48Al-2Nb-2Cr, a minor amount of beta phase particles smaller than about 5 μm in size is also present. For the forged Ti-48Al-2Nb-2Cr, the starting microstructure contains a majority of equiaxed or elongated gamma grains less than about 50 μm in size, a small amount of alpha-2 phase less than about 10 μm in size, and a minor amount of beta phase particles smaller than about 5 μm in size.

The first step of the method of the invention as applicable to P/M and wrought gamma alloys is a cyclic heat treatment carried out in vacuum or in an inert-gas atmosphere. The maximum temperature suitable for the cyclic treatment is in the range of about 10° C. above to about 10° C. below $T_\alpha$ of the alloy. $T_\alpha$ can be estimated with sufficient accuracy by long-time heat treatment and metallographic examinations. In each cycle, the material is heated to the maximum heat treatment temperature at a rate in the range of about 100° C. to 300° C./minute. The material is kept at the heat treatment temperature for about 10 to 20 minutes, and then cooled to a temperature below about 700° C. by a fan-forced air cool at a rate in the range of about 300° C. to 500° C./minute. The total number of cycles range from approximately 3 to 12. Generally, a shorter heat treatment time is used with a larger number of cycles. A larger number of cycles produces finer lamellar grains and fewer residual single-phase gamma grains.

The second step of the method involves a heat treatment to stabilize the microstructure of thus cyclically heat treated material. The heat treatment temperature can range between 750° C. and 1050° C., depending on the intended application temperature for the material. The heat treatment time ranges from 4 to 100 hours, or as long as required, followed by a furnace cool or an air cool.

Figure 8:
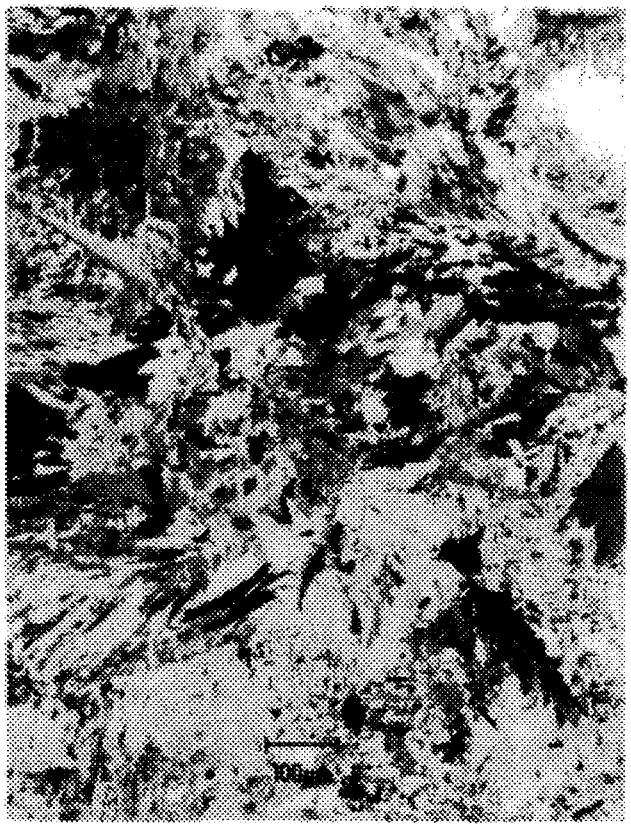
FIG. 8 is a 100× drawing illustrating a massively transformed microstructure produced by solution heat treating ingot cast Ti-48Al (at %)

For ingot cast or investment cast gamma alloys that have a coarse-grained lamellar microstructure, the first step of the invented method is a solution treatment, in which the gamma phase completely dissolves into alpha phase, at a temperature in the range of about 30° C. to 70° C. above $T_\alpha$ of the alloy for about 20 minutes to 2 hours. The heated material is then rapidly cooled to ambient temperature by water quenching or oil quenching to generate a massively transformed microstructure, as illustrated in FIG. 8.

The material which is solution-treated and massively transformed in this manner is then cyclically heat treated to produce a microstructure with refined lamellar colonies. The maximum temperature suitable for the cyclic treatment is in the range of about 10° C. above to about 10° C. below $T_\alpha$ of the alloy. In each cycle, the material is heated to the maximum heat treatment temperature at a rate in the range of about 100° C. to 300° C./minute. The material is kept at the heat treatment temperature for about 10 to 20 minutes, and then cooled to a temperature below about 700° C. by a fan-forced air cool at a rate in the range of about 300° C. to 500° C./minute. The total number of cycles range from approximately 3 to 12.

Following the cyclic heat treatment, a final heat treatment is applied to the material to stabilize the microstructure. The heat treatment temperature ranges between 750° C. and 1050° C., depending on the intended application temperature for the material. The heat treatment time ranges from 4 to 100 hours, or as long as required, followed by a furnace cool or an air cool.

The following examples illustrate the invention. In the examples, the alloy composition, material form, and $T_\alpha$ determined by long-time (100 hours) heat treatments are identified as follows:

| Nominal Alloy Composition (at %) | Material Form | $T_\alpha$ |
|---|---|---|
| Ti-48Al | HIP consolidated powder | 1370° C. ± 5° C. |
| Ti-47.5Al-3Cr | HIP consolidated powder | 1340° C. ± 5° C. |
| Ti-48Al-2Nb-2Cr | HIP consolidated powder | 1345° C. ± 5° C. |
| Ti-48Al-2Nb-2Cr | Hot forged cast ingot | 1365° C. ± 5° C. |
| Ti-48Al | Cast ingot | 1370° C. ± 5° C. |

EXAMPLE I

Heat treatment of HIP consolidated P/M Ti-48Al

Figure 2:
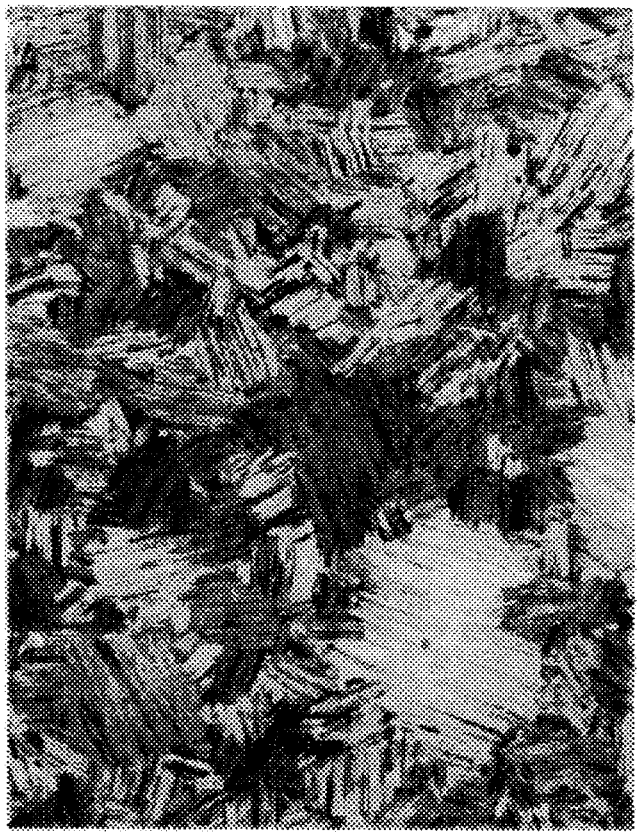
FIG. 2 is a 100× drawing illustrating a fine-grained fully lamellar microstructure produced by cyclically heat treating P/M Ti-48Al (at %) consolidated by hot isostatic pressing (HIP)
Figure 3:
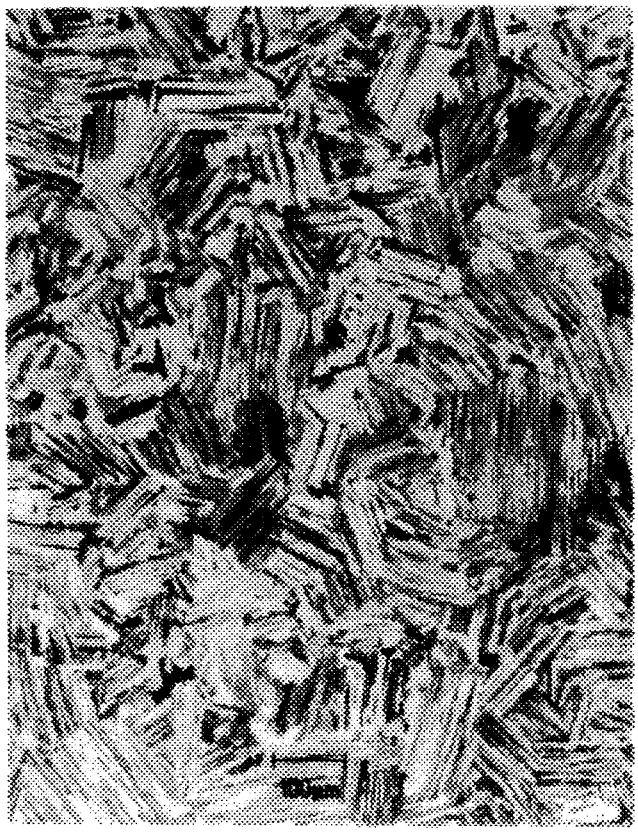
FIG. 3 is a 100× drawing illustrating a fine-grained lamellar microstructure produced by cyclically heat treating (primary treatment) HIP-consolidated P/M Ti-48Al (at %), followed by a microstructural stabilization treatment (secondary treatment)

A Ti-48Al (at %) powder alloy was HIP consolidated at 1050° C. and 207 MPa for 2 hours. The consolidated material was cyclically heat treated at 1370° C. for 6 cycles in an argon atmosphere. In each cycle, the material was heated to 1370° C. at a rate of about 200° C./minute, then kept at 1370° C. for 10 minutes, followed by a fan-forced air cool to about 500° C. at a rate of about 400° C./minute. The temperature fluctuation at the beginning of each cycle was approximately +2° C. to −1° C. relative to the set point temperature. FIG. 2 shows a fine-grained fully lamellar microstructure produced by the above mentioned cyclic heat treatment. For microstructural stabilization, a secondary heat treatment at 950° C. for 48 hours followed by a furnace cool was applied to thus cyclically heat treated material. FIG. 3 shows a fine-grained lamellar microstructure produced by the above mentioned cyclic heat treatment followed by the secondary heat treatment. Comparison of FIG. 3 with FIG. 2 reveals only slight increases in interlamellar spacing and volume fraction of single-phase gamma grains induced by the secondary heat treatment.

EXAMPLE II

Heat treatment of HIP consolidated P/M Ti-47.5Al-3Cr

Figure 4:
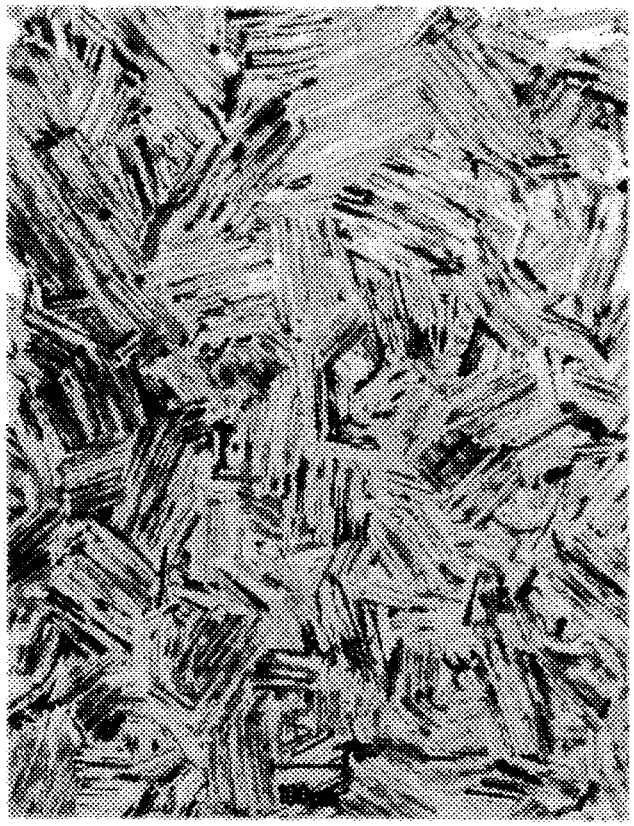
FIG. 4 is a 100× drawing illustrating a fine-grained lamellar microstructure produced by cyclically heat treating HIP consolidated P/M Ti-47.5Al-3Cr (at %), followed by a microstructural stabilization treatment.

A Ti-47.5Al-3Cr (at %) powder alloy was HIP consolidated at 1250° C. and 207 MPa for 2 hours. The consolidated material was cyclically heat treated at 1340° C. for 6 cycles in an argon atmosphere. In each cycle, the material was heated to 1340° C. at a rate of about 200° C./minute, then kept at 1340° C. for 10 minutes, followed by a fan-forced air cool to about 500° C. at a rate of about 400° C./minute. The temperature fluctuation at the beginning of each cycle was approximately +4° C. to −1° C. relative to the set point temperature. A secondary heat treatment at 950° C. for 48 hours followed by a furnace cool was applied to thus cyclically heat treated material to stabilize the microstructure. FIG. 4 shows a fine-grained fully lamellar microstructure produced by the above mentioned heat treatment. The tensile properties at room temperature (RT) and creep properties at 760° C. and an initial stress of 276 MPa for the material with the fine-grained fully lamellar microstructure are shown in Table I and Table II, respectively. For comparison, the properties of the alloy having duplex and fully lamellar microstructures produced by conventional heat treatments are also shown in the tables. The duplex microstructure was generated by a heat treatment at 1320° C. for 2 hours followed by air cooling. A secondary heat treatment at 950° C. for 48 hours followed by a furnace cool was used to stabilize the duplex microstructure. The fully lamellar microstructure resulted from a heat treatment at 1350° C. for 2 hours followed by a furnace cool. The similar secondary treatment was employed to stabilize the microstructure. Examination of the data in Tables I and II reveals a significant improvement in the balance of tensile and creep properties for the fine-grained fully lamellar microstructure produced by the method of the invention.

TABLE I

RT tensile for P/M Ti-47.5Al-3Cr

| Microstructure | 0.2% Y.S. (MPa) | U.T.S. (MPa) | Elong. (%) |
|---|---|---|---|
| Fine-grained fully lamellar | 411 | 523 | 1.9 |
| Duplex | 459 | 536 | 2.1 |
| Fully lamellar | 372 | 384 | 0.7 |

TABLE II

760° C./276 MPa creep properties for P/M Ti-47.5Al-3Cr

| Microstructure | Minimum Creep Rate ($h^{-1}$) | Rupture Life (h) |
|---|---|---|
| Fine-grained fully lamellar | $1.5 \times 10^{-4}$ | 294 |
| duplex | $1.5 \times 10^{-3}$ | 63 |
| Fully lamellar | $1.2 \times 10^{-4}$ | 537 |

EXAMPLE III

Heat treatment of HIP consolidated P/M Ti-48Al-2Nb-2Cr

Figure 5:
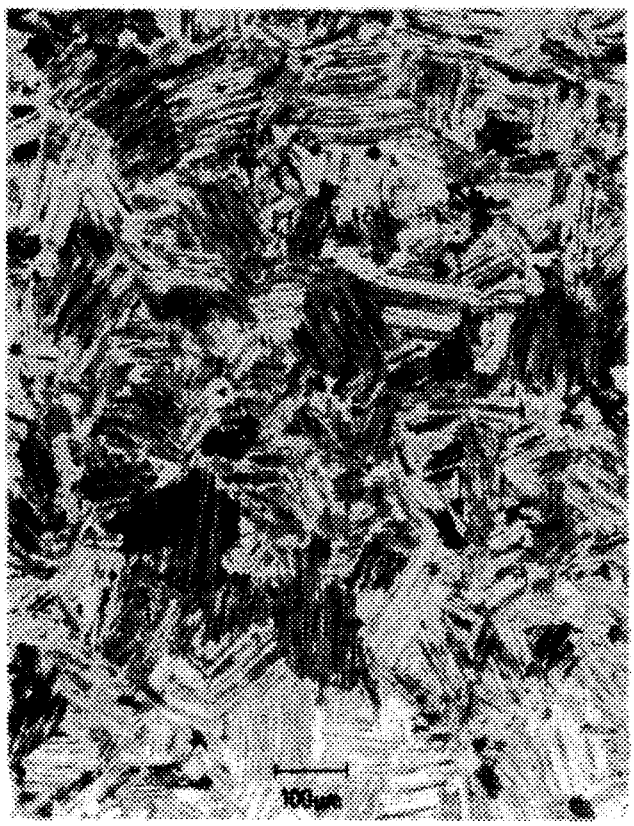
FIG. 5 is a 100× drawing illustrating a fine-grained lamellar microstructure produced by cyclically heat treating (6 cycles) HIP consolidated P/M Ti-48Al-2Nb-2Cr (at %), followed by a microstructural stabilization treatment.
Figure 6:
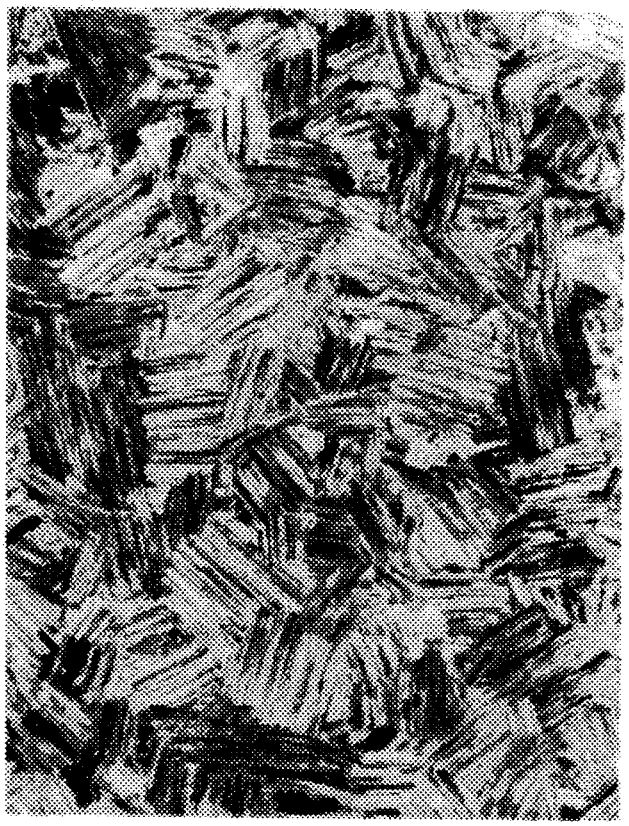
FIG. 6 is a 100× drawing illustrating a fine-grained lamellar microstructure produced by cyclically heat treating (12 cycles) HIP consolidated P/M Ti-48Al-2Nb-2Cr (at %), followed by a microstructural stabilization treatment.

A Ti-48Al-2Nb-2Cr (at %) powder alloy was HIP consolidated at 1080° C. and 207 MPa for 3 hours. The consolidated material was cyclically heat treated at 1350° C., which is 5° C. above $T_\alpha$, for 6 and 12 cycles respectively in an argon atmosphere. In each cycle, the material was heated to 1350° C. at a rate of about 200° C./minute, then kept at 1350° C. for 10 minutes, followed by a fan-forced air cool to about 500° C. at a rate of about 400° C./minute. The temperature fluctuation at the beginning of each cycle was approximately +4° C. to −1° C. relative to the set point temperature. A secondary heat treatment at 950° C. for 48 hours followed by a furnace cool was applied to thus cyclically heat treated materials to stabilize the microstructure. FIGS. 5 and 6 show fine-grained nearly and fine-grained fully lamellar microstructures produced by the above mentioned heat treatments with 6 and 12 cycles, respectively. The RT tensile properties, 760° C./276 MPa creep properties, and RT fracture toughness are shown in Tables III, IV and V, respectively. For comparison, the properties of the alloy having duplex and fully lamellar microstructures produced by conventional heat treatments are also shown in the tables. The duplex microstructure resulted from a heat treatment at 1300° C. for 1 hour followed by air cooling. A secondary treatment at 950° C. for 48 hours was used to stabilize the duplex microstructure. The fully lamellar microstructure was produced by a heat treatment at 1380° C. for 1 hour followed by furnace cooling. The similar secondary treatment was employed to stabilize the microstructure. Examination of the data in these tables reveals a significantly improved balance between the tensile, creep and fracture toughness properties for the fine-grained lamellar microstructures produced by the method of the invention. In particular, the fine-grained fully lamellar microstructure obtained by the method of the invention provides improved tensile and creep properties compared to the coarse-grained fully lamellar microstructure, with nearly equivalent fracture toughness.

TABLE III

RT tensile properties for P/M Ti-48Al-2Nb-2Cr

| Microstructure | 0.2% Y.S. (MPa) | U.T.S. (MPa) | Elong. (%) |
|---|---|---|---|
| Fine-grained nearly lamellar | 396 | 521 | 2.8 |
| Fine-grained fully lamellar | 382 | 509 | 1.7 |
| Duplex | 414 | 477 | 2.6 |
| Fully lamellar | 347 | 403 | 1.3 |

TABLE IV

760° C./276 MPa creep properties for P/M Ti-48Al-2Nb-2Cr

| Microstructure | Minimum Creep Rate ($h^{-1}$) | Rupture Life (h) |
|---|---|---|
| Fine-grained nearly lamellar | $2.7 \times 10^{-4}$ | 234 |
| Fine-grained fully lamellar | $1.2 \times 10^{-4}$ | 438 |
| Duplex | $2.2 \times 10^{-3}$ | 42 |
| Fully lamellar | $2.5 \times 10^{-4}$ | 206 |

TABLE V

RT fracture toughness for P/M Ti-48Al-2Nb-2Cr

| Microstructure | Plane-Strain (Chevron-Notch) Fracture Toughness, $K_{IVM}$ (Mpa$\sqrt{m}$) |
|---|---|
| Fine-grained nearly lamellar | 27.4 |
| Fine-grained fully lamellar | 26.4 |
| Duplex | 17.0 |
| Fully lamellar | 30.5 |

EXAMPLE IV

Heat treatment of isothermally forged Ti-48Al-2Nb-2Cr

Figure 7:
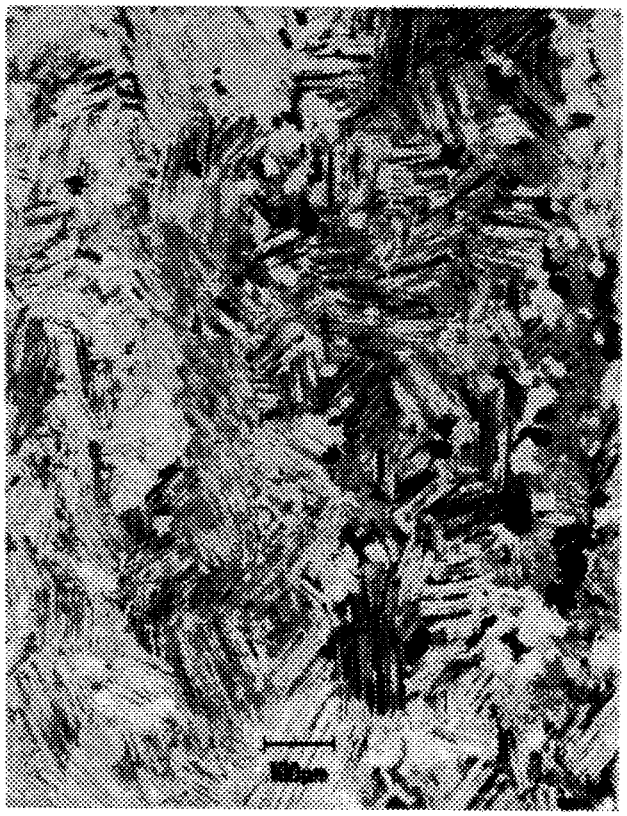
FIG. 7 is a 100× drawing illustrating a fine-grained lamellar microstructure produced by cyclically heat treating isothermally forged Ti-48Al-2Nb-2Cr (at %), followed by a microstructural stabilization treatment.

An ingot cast Ti-48Al-2Nb-2Cr (at %) alloy was HIP'ed, annealed, and then isothermally forged. The forged material was cyclically heat treated at 1360° C., which is 5° C. below $T_\alpha$, for 12 cycles in an argon atmosphere. In each cycle, the material was heated to 1360° C. at a rate of about 200° C./minute, then kept at 1360° C. for 10 minutes, followed by a fan-forced air cool to about 500° C. at a rate of about 400° C./minute. The temperature fluctuation at the beginning of each cycle was approximately +2° C. to −1° C. relative to the set point temperature. A secondary heat treatment at 950° C. for 48 hours followed by a furnace cool was applied to thus cyclically heat treated material to stabilize the microstructure. FIG. 7 shows a fine-grained lamellar microstructure produced by the above mentioned heat treatment.

EXAMPLE V

Heat treatment of ingot cast Ti-48Al

Figure 9:
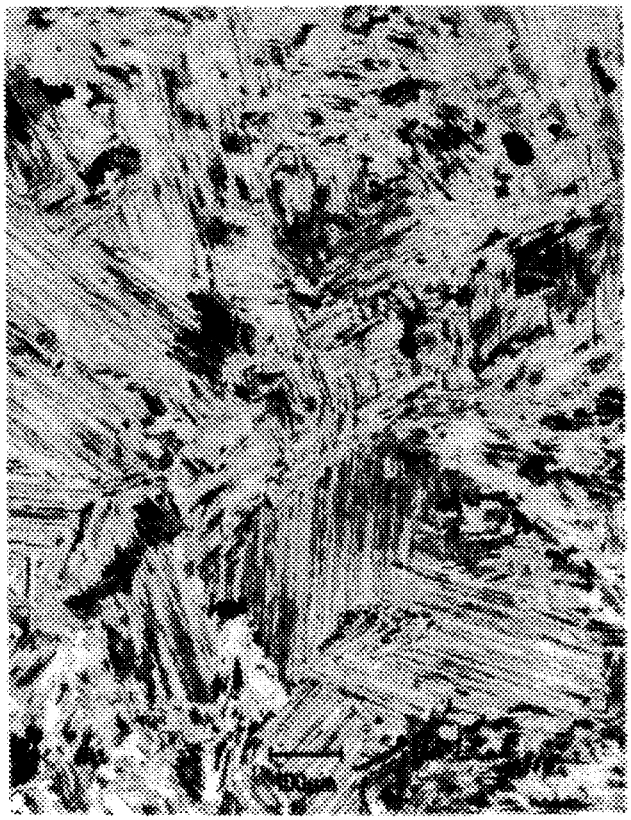
FIG. 9 is a 100× drawing illustrating fine lamellar colonies produced by solution heat treating (pretreatment), and then cyclical heat treatment (primary treatment) of ingot cast Ti-48Al (at %), followed by a microstructural stabilization treatment (secondary treatment).

An ingot cast Ti-48Al (at %) was solution treated at 1430° C. for 20 minutes followed by water quenching. FIG. 8 illustrates a massively transformed microstructure resulting from the solution treatment. The solution treated material was then cyclically heat treated at 1370° C. for 6 cycles in an argon atmosphere. In each cycle, the material was heated to 1370° C. at a rate of about 200° C./minute, then kept at 1370° C. for 10 minutes, followed by a fan-forced air cool to about 500° C. at a rate of about 400° C./minute. The temperature fluctuation at the beginning of each cycle was approximately +2° C. to −1° C. relative to the set point temperature. A final heat treatment at 950° C. for 48 hours followed by a furnace cool was applied to thus cyclically heat treated material to stabilize the microstructure. FIG. 9 shows fine-grained lamellar colonies in cast Ti-48Al produced by the above mentioned heat treatment.

Various modifications may be made to the invention as described without departing from the spirit of the invention or the scope of the appended claims. For example, in the solution treatment of cast gamma alloys, much less severe cooling such as fan-forced air cooling could be used during the pretreatment to produce a massively transformed microstructure in the alloys that are compositionally modified to promote massive transformation upon cooling. Cyclic heat treatment of thus solution treated material will subsequently result in a fine-grained lamellar microstructure.

We claim:

1. A method for producing gamma titanium aluminide alloys having a fine-grained lamellar microstructure, the method comprising the steps of:

a) cyclically heat treating a gamma titanium aluminide alloy by cyclically heating said alloy to a maximum temperature in the range of about 10° C. above the alpha-transus temperature of said alloy to about 10° C. below the alpha-transus temperature of said alloy and cooling said alloy to below a temperature of about 700° C., and b) heat treating said cyclically heat treated alloy at a temperature between about 750° and 1050° C. for about 4 to 100 hours.

2. The method according to claim 1 wherein the number of cycles is approximately from 3 to 12.

3. The method according to claim 2 wherein said alloy is heated to said maximum temperature at a rate in the range of about 100° C. to 300° C./minute, held at said maximum temperature for about 10 to 20 minutes, and said cooling to a temperature below about 700° C. is at a rate in the range of about 300° C. to 500° C./minute.

4. The method according to claim 1 wherein the alloy is a P/M or thermomechanically processed gamma titanium aluminide.

5. The method according to claim 1 wherein the step a) is carried out in vacuum or in an inert-gas atmosphere.

6. The method according to claim 1 wherein the step b) is followed by a furnace cool or an air cool.

7. The method according to claim 1 wherein the alloy is a cast gamma titanium aluminide and the method comprises, prior to the step a), the step of solution heat treating said alloy at a temperature in the range of about 30° C. to 70° C. above the alpha-transus temperature of said alloy for about 20 minutes to 2 hours followed by cooling.

8. The method according to claim 7 wherein said cooling from a temperature in the range of about 30° C. to 70° C. above the alpha-transus temperature is effected by an oil or water quench.

* * * * *